United States Patent [19]

Hallström

[11] Patent Number: 4,891,964

[45] Date of Patent: Jan. 9, 1990

[54] TOOL FOR THE FINAL FORMING OF CONNECTOR PIPES

[75] Inventor: Carl O. Hallström, Nälden, Sweden

[73] Assignee: C. Hallstroms Verkstader AB, Sweden

[21] Appl. No.: 140,773

[22] Filed: Jan. 4, 1988

[51] Int. Cl.[4] ..... B21D 39/00; B21D 41/04

[52] U.S. Cl. ..... 72/308; 72/312; 72/322; 72/393; 72/418; 29/509; 29/283.5

[58] Field of Search ..... 72/322, 393, 460, 300, 72/308, 312, 318, 392, 296, 306, 316, 317, 418; 29/509, 513, 283.5, 436, 522 R; 285/113

[56] References Cited

U.S. PATENT DOCUMENTS

| | | | |
|---|---|---|---|
| 1,039,948 | 10/1912 | Hunter | 72/393 |
| 1,706,910 | 3/1929 | Wright et al. | 72/393 |
| 2,155,542 | 4/1939 | Graham | 72/393 |
| 2,461,565 | 2/1949 | Morrill | 72/393 |
| 2,874,458 | 2/1959 | Smith | 29/436 |
| 3,012,319 | 12/1961 | Gould | 72/393 |
| 3,208,136 | 9/1965 | Joslin | 29/509 |
| 3,388,456 | 6/1968 | McKinven, Jr. | 29/509 |
| 3,412,592 | 11/1968 | Ramsey | 72/316 |
| 4,262,518 | 4/1981 | Creger et al. | 72/393 |
| 4,356,888 | 11/1982 | Steenberg | 292/522 R |

FOREIGN PATENT DOCUMENTS 78101102 6/1978 Sweden .

*Primary Examiner*—Robert L. Spruill
*Attorney, Agent, or Firm*—Witherspoon & Hargest

[57] ABSTRACT

The present invention briefly relates to a tool for the synchronous operation of fastening a seal ring to a connector pipe, crimping of the flange-like portion resulting from the clamping, and forming of the end portion of the connector pipe. The tool comprises a calibration ring (11) into which the pipe end portion is inserted for calibration, a pull rod (1) extending centrally through the calibration ring (11) and a set of form chucks (5) around the pull rod (1). The form chucks (5) are prestressed against and in cooperation with a cone (2) provided at the pull rod end, so that when the pull rod (1) is displaced in such a way that the cone (2) moves toward the calibration ring (11), the form chucks (5) at first are being pressed radially outward by the cone (2) to engage the inner side of the connector pipe and then are pulling the connector pipe by means of the pull rod (1). The end of the connector pipe is pressed into the calibration ring (11) where it is calibrated at the same time as the projection on the form chucks (5), clamps and crimps the flange-like portion of the connector pipe.

5 Claims, 5 Drawing Sheets

TOOL FOR THE FINAL FORMING OF CONNECTOR PIPES

The present invention relates to a tool for the final forming of connector pipes. More particularly the invention comprises fastening of a seal ring to the connector pipe, crimping of a flange-like part, which projects radially in the connector pipe, and forming of the end portion of the connector pipe to predetermined form and dimension, whereby all these stages are carried out in one operation.

From the Swedish patent specification No. 7810110-2 a connector pipe of this kind is known, to which the present invention is relating. This known connector pipe basically consists of a sheet steel pipe. The end portions thereof are with a little play adapted to be inserted into the ends of the pipes that are to be connected. In order for the annular slot to be properly sealed there is provided at least one seal ring of a rubber or other elastic material. The seal ring consists of a flat, ring-shaped washer. The radially inner part of this washer is positioned in a ring-shaped recess of the connector pipe. The opposite radial walls of the recess are pressed against each other for clamping the seal ring between these walls.

The flange-like portion projects radially very little into the canal where the seal ring is positioned. Yet, under certain very unfavourable circumstances there is a risk that just at this flange-like part turbulence will be formed by the medium streaming through the pipe canal. This turbulence may cause noise. This risk increases with a decreasing diameter of the connector pipe, since the flange then will be proportionally larger relative to the inner diameter of the connector pipe.

When the recess for the seal ring is being beaded a connector pipe deformation of higher or smaller degree can occur. Therefore the form of the connector pipe must be controlled and, if necessary, calibrated, so that it attains the right dimensions and forms enabling it to fit into the pipes, to which it is intended to connect.

The objective of the present invention is to provide a method, by means of which fastening of the seal ring by clamping the opposite, radial walls of the recess, crimping of the flange-like part resulting from the clamping of the seal ring and projecting radially inward and constituting the actual recess, and forming of the end portion of the connector pipe to predetermined form and dimension, can be carried out in one operation.

This objective is achieved by the method and by the tool according to the accompanying patent claims.

Figure 1:
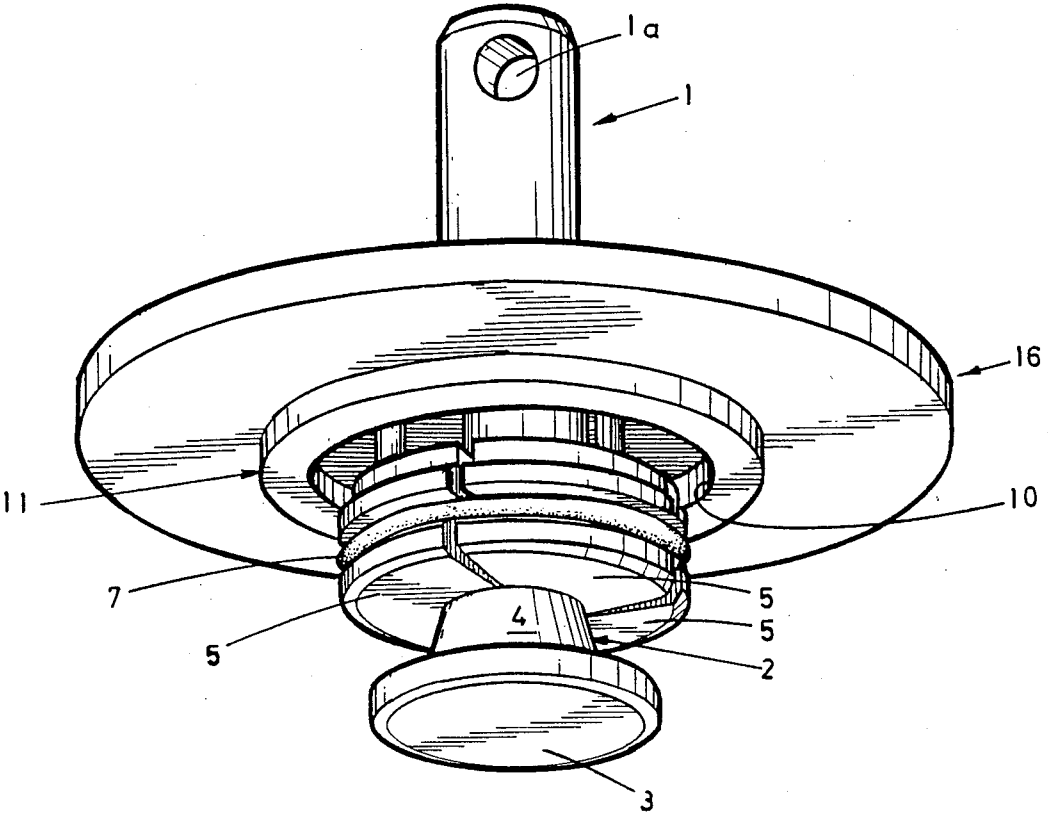

The invention will be described in more detail below in conjunction with the attached drawings, in which FIG. 1 is a perspective view of a tool for carrying out the method according to the invention.

Figure 3:
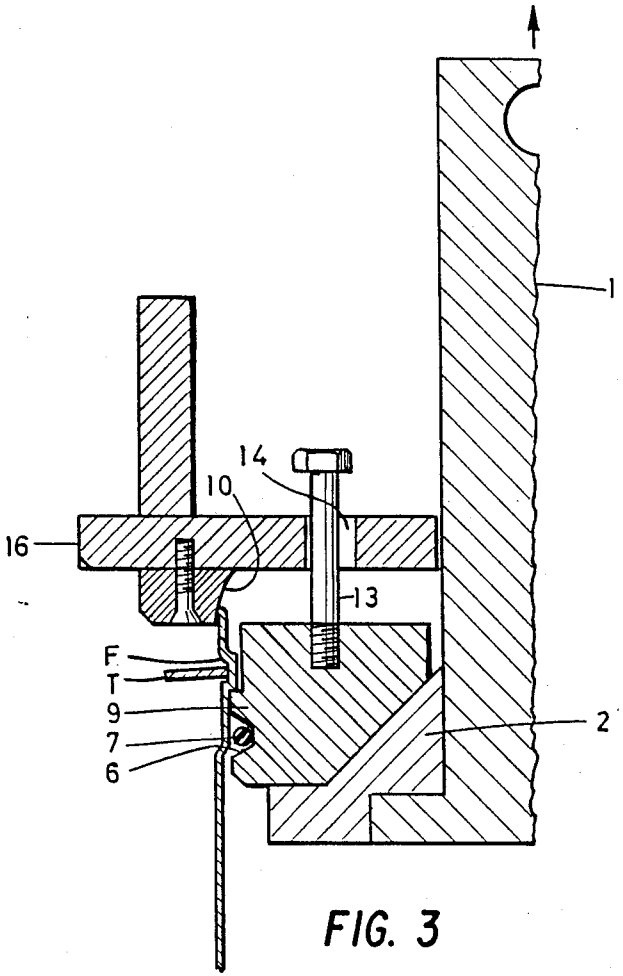
Figure 2:
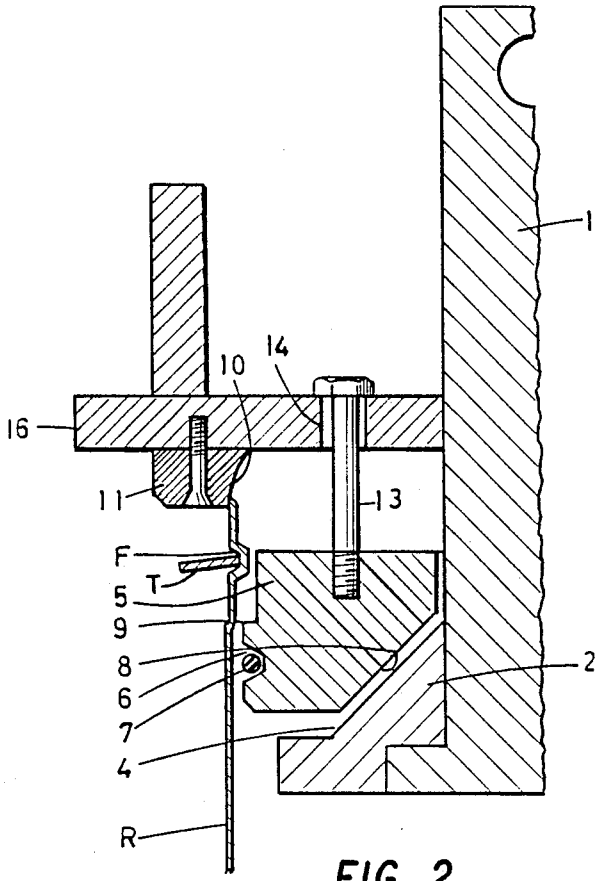
Figure 5:
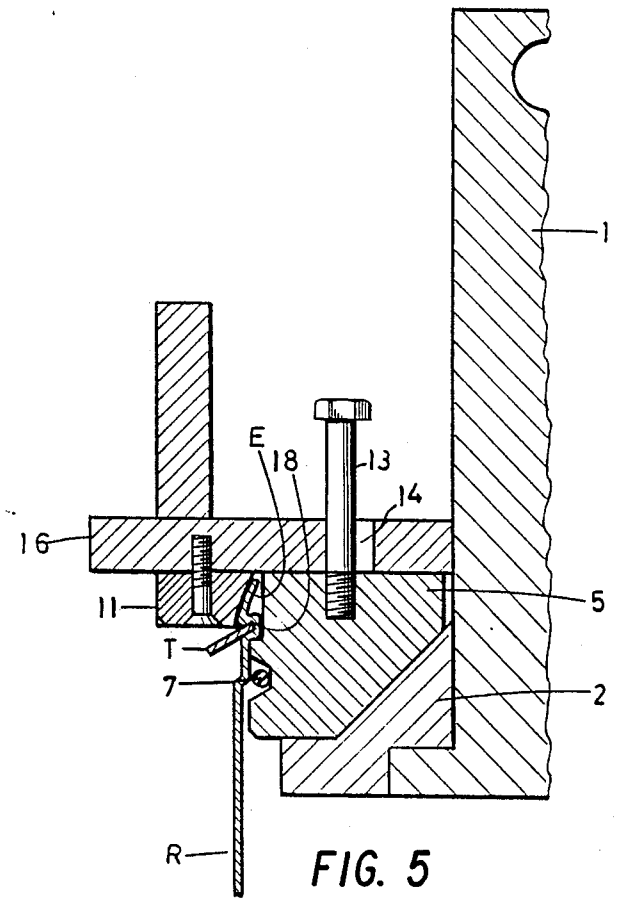
Figure 4:
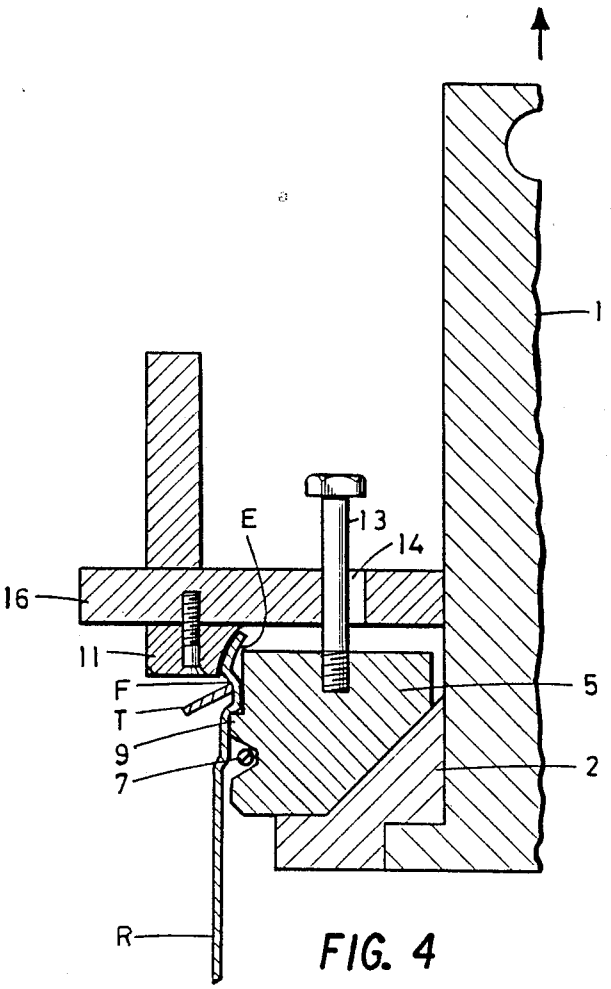
Figure 7:
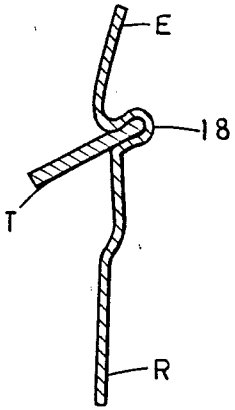
Figure 6:
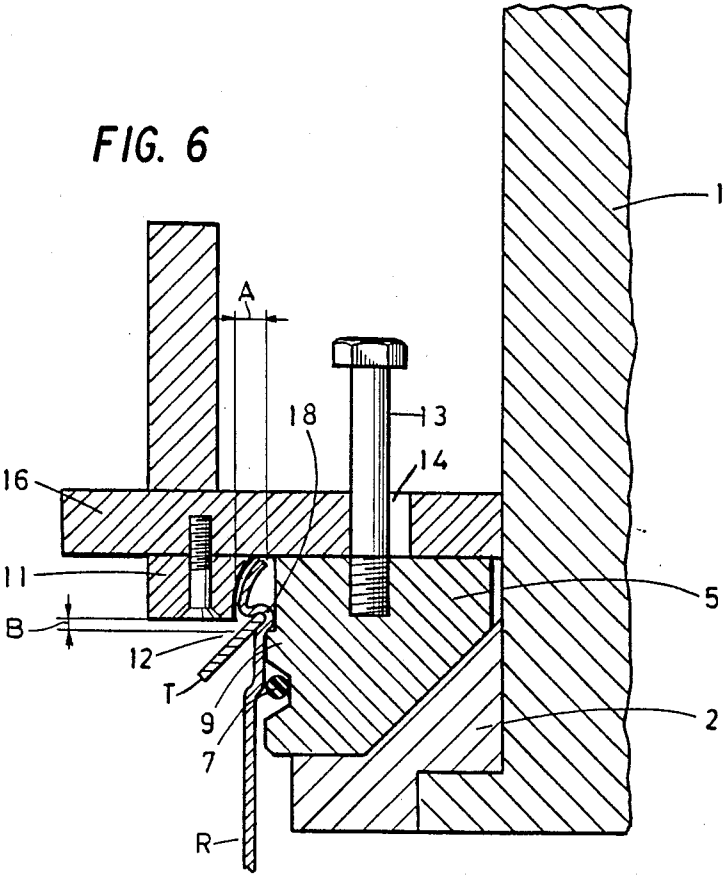
Figure 8:
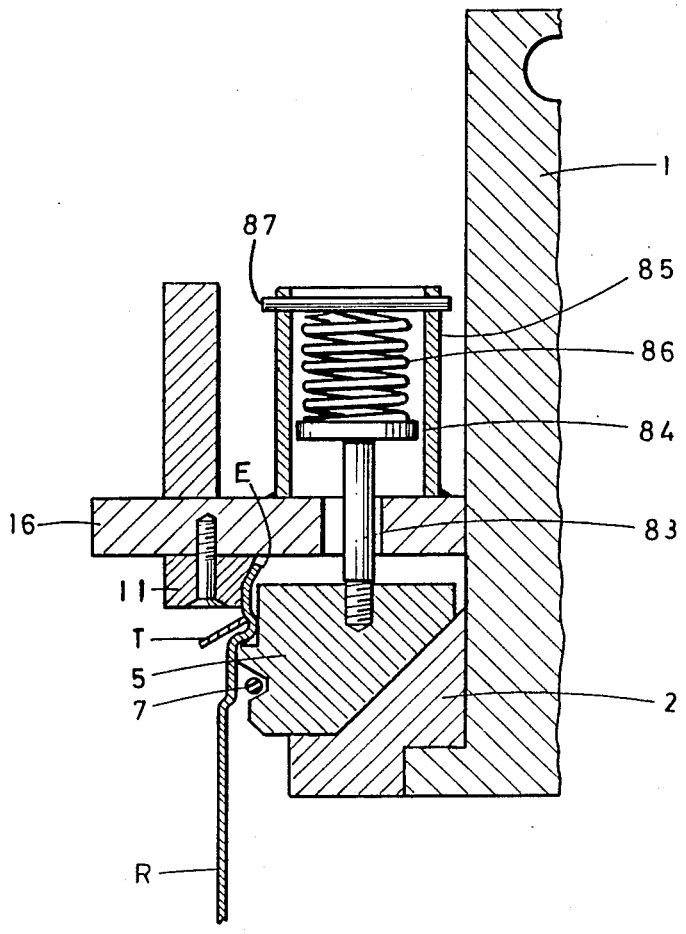

FIGS. 2–5 illustrate schematically cut away sections through the tool of FIG. 1 showing different steps of the method, whereby FIG. 2 illustrates the tool in its initial position with an applied connector pipe which is to be positioned, FIG. 3 illustrates the position, wherein the form chucks of the tool have come to engagement with an abutment and at the same time are carried radially outward to an engagement against the inner side of the connector pipe and wherein the clamping of the seal ring is in initial process, FIG. 4 illustrates the position, wherein crimping of the flange-like portion begins at the same time as clamping of the seal ring occurs and forming of the pipe end portion begins, and FIG. 5 illustrates the final position, wherein the seal ring is clamped, the flange-like portion projecting inside the connector pipe is crimped to desired extent and the end portion of the connector pipe has its final form, FIG. 6 is an enlargement of FIG. 5 and shows the ratio between crimping surfaces of the tool and crimped connector pipe, FIG. 7 schematically illustrates a cut away section through a crimped connector pipe, and FIG. 8 schematically illustrates a cut away section through a modified embodiment of the tool.

In FIG. 1 there is shown in a perspective view a preferred embodiment of the device or tool according to the invention. The tool includes a pull rod 1, the end portion of which is provided with a replaceable end portion in the form of a truncated cone 2. The cone 2 encompasses the pull rod 1. It is retained by this rod through an end piece 3 on the pull rod 1 in the form of a radially projecting flange. The truncated cone 2 increases its diameter in the direction of the end piece 3 of the pull rod 1. The truncated cone 2 can be applied over and on to the pull rod 1. The cone can therefore in a very simple way be exchanged when showing wear or when it is desirable to change the cone angle. The envelope surface of the cone 2 is referred to as 4.

In the initial position of the tool the rod 1 adjacent to the cone 2, as well as a part of the cone 2, is encompassed by a set of form chucks 5, each having the form of a circular segment. The radially inner surface 8 of the chucks 5 has the same conical form as the envelope surface 4 of the cone 2. In order for the form chucks 5 to be retained together and be prestressed inwardly against the rod 1 and the cone 2, there is provided, in the shown embodiment, an elastic retaining strap 7 around the periphery defined jointly by the form chucks 5, the strap resting recessed in a groove 6. The form chucks 5 are made from a circular disc or plate with a central opening, the wall of which at least for a part of its height is conical, as shown at 8, for cooperation with the cone 2. The form chucks 5 are realized by the plate being divided into circular segments through radial sections. The original, circular plate periphery generally corresponds to or is somewhat smaller than the inner periphery of the connector pipe which is to be formed. This means that each tool is adapted to only one size of the connector pipe. When for the realization of the different chucks 5 the plate is sectioned, a minor material abatement occurs. This will render the perimeter of the chucks 5 in an assembled and stressed position around the pull rod 1 somewhat smaller than the perimeter of the original plate. The chucks 5 can therefore easily be inserted into a connector pipe which is not deformed to any considerable extent. This means that the tolerance level of the connector pipe is determined by the formed chucks 5.

A plate 16, which in the shown embodiment is circular, is intended to be the stationary part of the tool and to be removably attached to the machine, which performs the actual pulling operation, which will be described further below. The pull rod 1, which has a through-mounting hole **1*a* at the opposite end of the cone 2, displaceably extends through a central opening of the plate 16. A calibration ring 11 is mounted on the plate 16, concentrically to the pull rod 1. This ring has a forming surface 10, which in the shown embodiment has a profile that inclines inwardly. As for the formed chucks 5 this calibration ring 11 is adapted to a certain size of connector pipe. Thus, a set of formed chucks 5 and a calibration ring 11** constitute a set for a certain size of connector pipe.

It is especially evident from FIGS. 2–5 that each form chucks 5, is retained in place relative to the plate 16 by means of screws 13 extending through a hole 14 in the plate 16 and screwed into each form chuck 5 respectively. The holes 14 have a somewhat larger diameter than the shaft of the screws 13, so that the chucks 5 can therefore move without permitting the screwheads to penetrate. When, in an initial stage, screws 13 are screwed into the chucks 5, the screwheads are resting against the plate 16, as shown in FIG. 2. In this shown position the tool is ready to start a forming operation.

The connector pipes, that are to be formed by means of the described tool, are prepared at least to such an extent that they through a beading operation are provided with a recess F encircling the envelope surface, wherein a flat disc-shaped seal ring T of rubber or similar material is positioned edgeways, i.e. generally perpendicular to the connector pipe.

In FIG. 2 there is shown the beginning of an operation according to the invention. A connector pipe R has been applied over the form chucks 5 into a calibration ring 11, as far as this is possible considering that its inwardly directed calibration surface 10 has conical form with a diameter that decreases from its mouth. That the pipe R can be brought into the calibration ring 11 means that it does not exceed permitted tolerance levels as far as roundness and maximum diameter are concerned.

In FIG. 3 there is shown the next stage of the operation. The pulling of the pull rod 1 in the arrow direction has caused the form chucks 5 to engage with the cone 2 and to be pressed radially outward, so that a projection 9 on their peripheral surface is brought into engagement with the inside of the connector pipe R in an axial direction right inside the recess F. In this position the form chucks 5 cannot move radially any further outward.

In FIG. 4 the continuation of the operation is shown. The projection 9 has there come into engagement with the axially inner wall of the recess F and started to pull said wall toward the axially outer wall of the recess, at the same time as the end E of the connector pipe R is being pressed a little ways into the calibration ring.

In FIG. 5 the end of the operation is shown. The form chucks then have been pulled so that they engage with the plate 16, and the projection 9 has pressed the axially opposite walls of the recess F together. These walls constitute a marked, inward protrusion or a flange 18, wherein the seal ring is clamped. Furthermore, the protrusion or flange 18 have been crimped so that it has adopted an angle of approximately 40–45° to the inner side of the pipe R.

The radially inner part of the seal ring T is as mentioned clamped in the protrusion 18 and the inclination of this protrusion renders a corresponding inclination for the seal ring T. The pressing movement exerted by the projection 9 against the protrusion 18 results in the clamping, whereby the seal ring T is retained in place, and also in a crimping or off-setting defined by the protrusion 18 against the general plane of the pipe R. If this clamping is too forceful, the seal ring T breaks, and if the off-setting is too strong, the radially projecting part of the seal ring T, which performs the actual sealing, will be pressed down against the outside of the connector pipe R. In that case a good sealing effect will not be achieved. Surfaces in conjunction with the seal ring should be softly rounded to prevent the seal ring from damages.

In FIG. 6 there is shown the relationship between those parts causing the crimping. Thus the distance A between the entrance edge of the calibration ring 11 and the crimping edge 12, viewed in a radial direction, must not be lower than twice the gauge thickness of the connector pipe R. The axial distance B between said edges determines in cooperation with the distance A to which extent the protrusion 18 is crimped.

In FIG. 7 there is schematically shown a cut away section through a connector pipe R formed according to the invention. The end E of the connector pipe R has undergone a calibration, which will make it fit into such pipes, where it will be used. At the same time it has received a soft, inward bending or conicity facilitating the adjustment of the connector pipe R. The protrusion 18 has undergone a slight crimping, which renders a sufficient increase in the diameter of the connector pipe right at this spot, so that the initially mentioned risk for noise should be eliminated.

For the embodiment of the tool according to the invention shown in FIGS. 1–6, the tool is intended to be mounted as shown. This means that the tool will in general work vertically. This also means that the form chucks 5 as well as the pull rod 1 with its conical portion 2 will return to the initial position according to FIG. 2 by the influence of gravity. For certain applications such a positioning of the tool is not possible. In that case the tool will have to be somewhat modified. Such a modification is shown in FIG. 8.

The embodiment of the tool according to the invention shown in FIG. 8 is different from the one earlier described by having its screw 13 replaced by a screw 83 with a relatively extended head 84. This head 84 is surrounded by a steering guide or a sleeve 85, which is fastened to the plate 16 which has such a height, that there is space enough for a pressure spring 86 to be placed between the head 84 and a pin 87 adjacent to the outer end of the sleeve 85. The spring 86 thus keeps the form chucks 5 as well as the pull rod with its conical portion 2 prestressed against the initial position, wherein a connector pipe can be applied over the form chucks 5 for the calibration and forming.

By the present invention those initially posed objectives have thus been achieved. However, within the scope of the invention as being defined in the accompanying claims, many various embodiments may appear.

I claim:

1. Apparatus for working a connector pipe to clamp a seal ring into a recess in said connector pipe and to form an end portion of said connector pipe, comprising:

a rod extending along a longitudinal axis from a first end to an opposite second end, said rod being reciprocable along said longitudinal axis relative to a calibration ring;

a calibration ring extending about said longitudinal axis and about said rod and having an inner forming surface facing said longitudinal axis;

a cone-shaped surface at said opposite second end of said rod for reciprocable movement with said rod along said longitudinal axis relative to said calibration ring, said cone-shaped surface facing away from said longitudinal axis and increasing in diameter towards said opposite second end, said cone-shaped surface including a flange extending in a radial direction away from said longitudinal axis at said opposite second end, a plurality of form chucks extending radially about said rod and said longitudinal axis, each form chuck being in the shape of a circular segment, each form chuck of said plurality of form chucks having (a) an inner inclined surface facing said longitudinal axis for engagement with and sliding movement relative to said cone-shaped surface, and (b) an outer surface projecting radially away from said longitudinal axis, each form chuck including a lower surface for engagement with and sliding movement relative to said flange, resilient means engaging said plurality of form chucks for retaining each form chuck in position relative to said rod;

said plurality of form chucks being moveable radially and in the direction of said longitudinal axis towards said calibration ring to so work said connector pipe therebetween when each inner inclined surface is caused to engage and slide relative to said cone-shaped surface as said rod and said cone-shaped surface are moved vertically along said longitudinal axis in a direction towards said calibration ring, a plate having an aperture therethrough, said calibration ring being affixed to a first side of said plate, and said rod extending through said aperture from said first side such that said cone-shaped surface, and said plurality of form chucks, are on the same side of said plate as said calibration ring, and a respective screw extending from an opposite second side of said plate through a respective enlarged aperture in said plate, said respective screw being threaded into a respective form chuck to support said respective form chuck in the vicinity of said first side of said plate, each respective screw being of a length for longitudinal axial movement thereof with each respective form chuck and said rod, and relative to said calibration ring, during said working of said connector pipe.

2. The apparatus of claim 1 wherein each respective screw has an extended head which is surrounded by a respective steering guide extending from said opposite second side of said plate, and further including a pressure spring positioned between said extended head and a pin adjacent an outer end of said steering guide.

3. The apparatus of claim 1 wherein said plurality of form chucks move radially outward towards said calibration ring to the extent of having a maximum outer diameter defined by said form chucks which is somewhat similar than an inner diameter defined by said inner forming surface.

4. The apparatus of claim 4 said cone-shaped surface and said inner inclined surface have the same curvature radius and chamfer.

5. The apparatus of claim 1 wherein each form chuck includes a groove along an outer periphery, and further wherein said retaining means includes an elastic retaining strap positioned in said grooves.

* * * * *